US005189810A

United States Patent [19]

Vetter

[11] Patent Number: 5,189,810

[45] Date of Patent: Mar. 2, 1993

[54] METHODS AND APPARATUS FOR THE CONTINUOUS HEAT TREATING OF YARN

[75] Inventor: Gerhard Vetter, Süssen, Fed. Rep. of Germany

[73] Assignee: Michael Horauf Maschinenfabrik GmbH & Co. KG, Donzdorf, Fed. Rep. of Germany

[21] Appl. No.: 603,303

[22] Filed: Oct. 24, 1990

[30] Foreign Application Priority Data

Nov. 17, 1989 [DE] Fed. Rep. of Germany ..... 3938183

[51] Int. Cl.[5] ..... F26B 7/00

[52] U.S. Cl. ..... 34/1.8; 34/23; 34/155; 34/34; 34/162; 34/216; 8/149.3; 8/151.2; 68/5 C

[58] Field of Search ..... 34/17, 18, 23, 34, 154, 34/155, 162, 214, 212, 216, 217, 218, 219, 226, 231, 233; 68/5 C, 5 D, 5 R; 8/151, 149.2, 149.3, 151.2

[56] References Cited

U.S. PATENT DOCUMENTS

| | | | |
|---|---|---|---|
| 2,318,511 | 5/1943 | McAllister | 34/231 |
| 4,026,036 | 5/1977 | Tanaka | 34/155 |
| 4,067,318 | 1/1978 | Flaith et al. | 34/216 |
| 4,119,753 | 10/1978 | Smart | 34/243 F |
| 4,121,311 | 10/1978 | Meyer | 8/149.3 |
| 4,137,648 | 2/1979 | Rhodes | 34/212 |
| 4,231,165 | 11/1980 | Gresens et al. | 34/212 |
| 4,252,133 | 2/1981 | Buske et al. | 34/155 |
| 4,283,454 | 8/1981 | Buchanan | 34/243 F |
| 4,365,423 | 12/1982 | Arter et al. | 34/231 |
| 4,392,309 | 7/1983 | Schrader et al. | 34/155 |
| 4,513,514 | 4/1985 | Steiner . | |
| 4,907,310 | 3/1990 | Enderlin | 34/1 |

FOREIGN PATENT DOCUMENTS

| | | |
|---|---|---|
| 2069690 | 9/1972 | France . |
| 2246678 | 5/1975 | France . |
| 2584429 | 1/1987 | France . |

*Primary Examiner*—Henry A. Bennett
*Assistant Examiner*—Denise L. F. Gromada
*Attorney, Agent, or Firm*—Burns, Doane, Swecker & Mathis

[57] ABSTRACT

Carpet yarns which have been previously mechanically compressed, are heat set in a yarn heat treating chamber by superheated steam. The yarn treating chamber operates under atmospheric pressure. Several yarns are passed through the yarn treating chamber on respective perforated conveyor belts. The steam is conducted so that it is forced to flow downwardly through the yarns and through the permeable conveyor belts. To avoid the formation of condensate water on the conveyor belts, the belts are in the form of nonmetallic nets, upon which the yarns are deposited in the form of loops.

9 Claims, 4 Drawing Sheets

METHODS AND APPARATUS FOR THE CONTINUOUS HEAT TREATING OF YARN

BACKGROUND OF THE INVENTION

The invention concerns methods and apparatus for the continuous heat treating of yarn, such as carpet yarn, which may be moved into and from a yarn treating chamber by means of conveyor belts, with superheated steam being circulated in the chamber and directed to pass through the yarn by a flow guide.

An apparatus of this type is known from U.S. Pat. No. 4,513,514. In this apparatus, for each individual yarn a so-called lap holding mast equipped with four narrow revolving conveyor belts is provided, whereby the individual yarns are wound in controlled loops around the mast and the conveyor belts.

This type of yarn guidance prevents the yarns from coming into contact with a steel belt (as is frequently used in yarn treating chambers), and thus with residues of condensation water, which necessarily form on metal belts due to cooling outside the treating chamber. However, problems arise if the yarn to be set in that manner has been previously mechanically compression set, for example in a frisé machine. That is, the method of yarn guidance disclosed in U.S. Pat. No. 4,513,514 causes the frisé pattern present in the yarn to be compressed, whereby the quality of the set yarn can be adversely affected.

Therefore, the heat setting of previously mechanically compression set yarn is in actual practice performed by so-called closed systems, in which the conveyor belts are situated entirely within the heating chamber, i.e. the belts have no inlet into the yarn heat treating chamber and no outlet therefrom. A perforated steel conveyor belt is used, onto which the yarns are deposited in loops. The saturated steam used as the treatment medium flows under pressure through the conveyor belt and the yarns located on it. However, the use of saturated steam was found to be detrimental in the heat setting of the yarns.

In the case of other yarn treating installations (e.g., French Patent 25 84 429), a steaming chamber is known, in which a so-called open system is used with a continuous perforated conveyor belt. The yarn here again is treated with saturated steam, but under atmospheric pressure. A conventional perforated steel strip is used, which is passed over a roll and exposed to steam by means of a roof shaped steam conducting installation located under it. The apparatus is not suitable for the heat setting of mechanically compression set yarn.

It is an object of the invention to provide methods and apparatus of the aforementioned type so that the relatively expensive guidance on lap holding masts is avoided.

SUMMARY OF THE INVENTION

This object is achieved by an apparatus according to the present invention for the continuous heat treatment of yarns. The apparatus comprises a heating chamber and a conveyor belt arranged for conveying yarn into and from the heating chamber. The conveyor belt comprises a permeable nonmetallic net onto which yarn is deposited in loop form. Superheated steam is circulated within the heating chamber. A steam guiding structure is situated above the conveyor belt for guiding the steam downwardly toward the conveyor belt and the yarn disposed thereon.

Preferably, the steam guiding structure tapers toward the conveyor belts so as to cause the steam to accelerate as it approaches the conveyor belt.

A climatic control device is situated at the conveyor inlet and conveyor outlet of the heating chamber. Each climatic control device comprises a conduit for directing steam upwardly toward the conveyor belt in counterflow relationship to steam guiding downwardly from the steam guiding structure.

The present invention also involves a method of heat treating previously mechanically compressed yarn. The method comprises depositing the yarn in loop form onto an upper surface of a perforated nonmetallic conveyor belt. The conveyor belt is passed into a heating chamber wherein superheated steam is circulated. The steam is guided downwardly toward the upper surface of the conveyor belt and yarn disposed thereon. Thereafter, the conveyor belt is passed out of the heating chamber.

In contrast to the known installations for the heat setting in frisé plants, superheated steam is used in place of saturated steam. The closed yarn treating systems used heretofore are replaced according to the invention by an open system wherein the conveyor belt conveys the yarn into and from the heating chamber. Furthermore, the perforated conveyor belt is not made of metal, because metals, due to their thermal conductivity, cause the conveyor belt to cool outside the yarn treating chamber, whereby water condenses on the belt (water being "lethal" to the yarn in heat setting). For this reason, according to the invention a conveyor belt comprising a nonmetallic material is used, which in addition is in the form of a preferably woven or plaited net, which is penetrated particularly well by the superheated steam. In this manner, the need to guide the yarn on a lap holding mast as in the prior art is avoided.

The net-like, nonmetallic conveyor belt that (in contrast to prior art steel conveyor belts) is flexible, is being guided laterally mechanically over its entire length, with the individual conveyor belts moving in a straight line through the yarn treating chamber. In order to obtain a high velocity of superheated steam flow through the yarn, the flow guiding means has a flow cross section tapering toward the conveyor belt. Conveniently, each conveyor belt is preceded by a flow rectifier, between which and the conveyor belt a perforated sheet is preferably placed, whereby the temperature is equalized over the width of the treating chamber.

In a further development of the invention a climatic interlock is provided for the conveyor both at the inlet and the outlet of the treating chamber. The interlock operates by the counter current principle. This increases the efficiency of the installation, as the escape of the superheated steam is largely prevented.

The nonmetallic perforated, net-like conveyor belt preferably is in the form of a coated plastic strip, which is made into an endless conveyor belt by joining its ends together by nonmetallic fasteners.

BRIEF DESCRIPTION OF THE DRAWINGS

The objects and advantages of the invention will become apparent from the following detailed description of a preferred embodiment thereof in connection with the accompanying drawings in which like numerals designate like elements, and in which.

DETAILED DESCRIPTION OF A PREFERRED EMBODIMENT OF THE INVENTION

Figure 1:
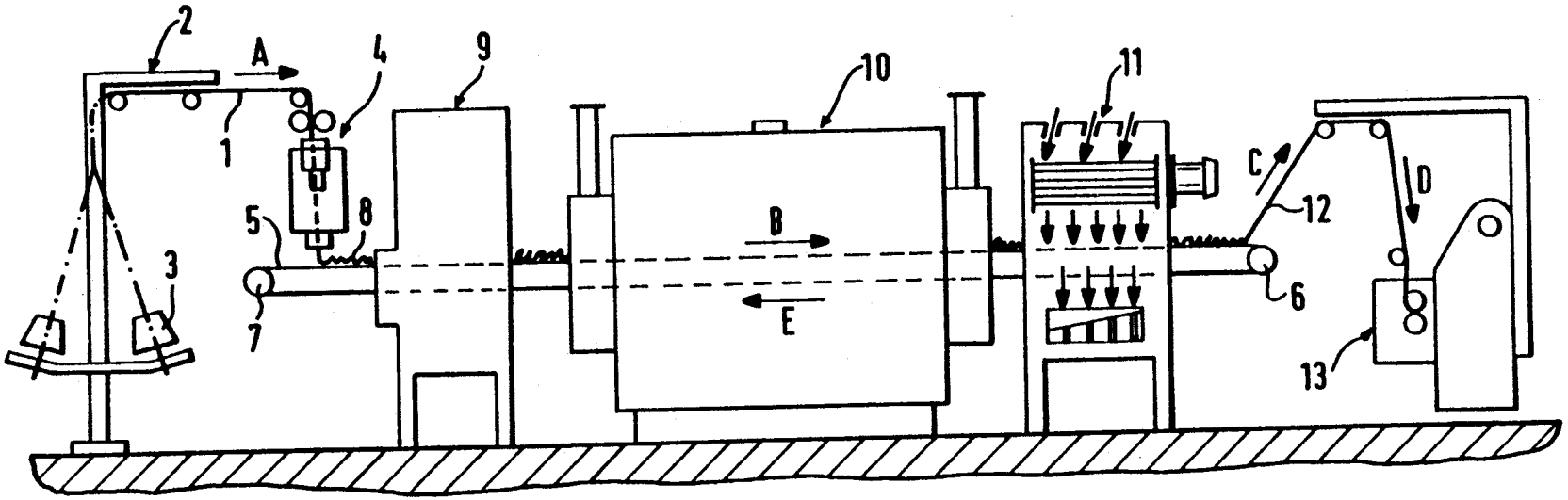
FIG. 1 depicts schematically in side elevation a frisé installation including a yarn treating chamber.

The frisé installation according to FIG. 1 for the treatment of yarns 1, which pass through the installation in the direction of the arrow A, comprises a creel 2 with feed spools 3 for the individual yarns to be treated. Each yarn is provided with conventional means 4 for the placement of random or ordered yarn loops 8 onto a perforated conveyor belt 5. The individual conveyor belts consist of a plastic coated nonmetallic net belt joined at its ends by nonmetallic joints to define an endless belt with upper and lower flights. The belt is guided by means of reversing rolls 6 and 7, one of which, for example, the roll 6, is driven. The yarns 1 are located in random or ordered loops 8 on the individual perforated conveyor belts 5. Upper flights of the conveyor belts 5 are running linearly in the direction of the arrow B through the frisé installation and the bottom flights are returning in the direction of the arrow E.

The yarns 1 located in loops on an upper support surface defined by the conveyor belts 5 initially pass through a frisé installation 9, wherein they are mechanically compression set in a known manner. Subsequently, the compression set yarns 1 are heat set in a yarn treating chamber 10 under the effect of superheated steam. The yarn treating chamber 10, which thus constitutes a heating chamber, is followed by a so-called yarn cooler 11, after which the heat set yarns 12 are drawn off the individual conveyor belts 5 in the direction of the arrow C and moved in the direction of the arrow D to a spooling machine 13.

Figure 2:
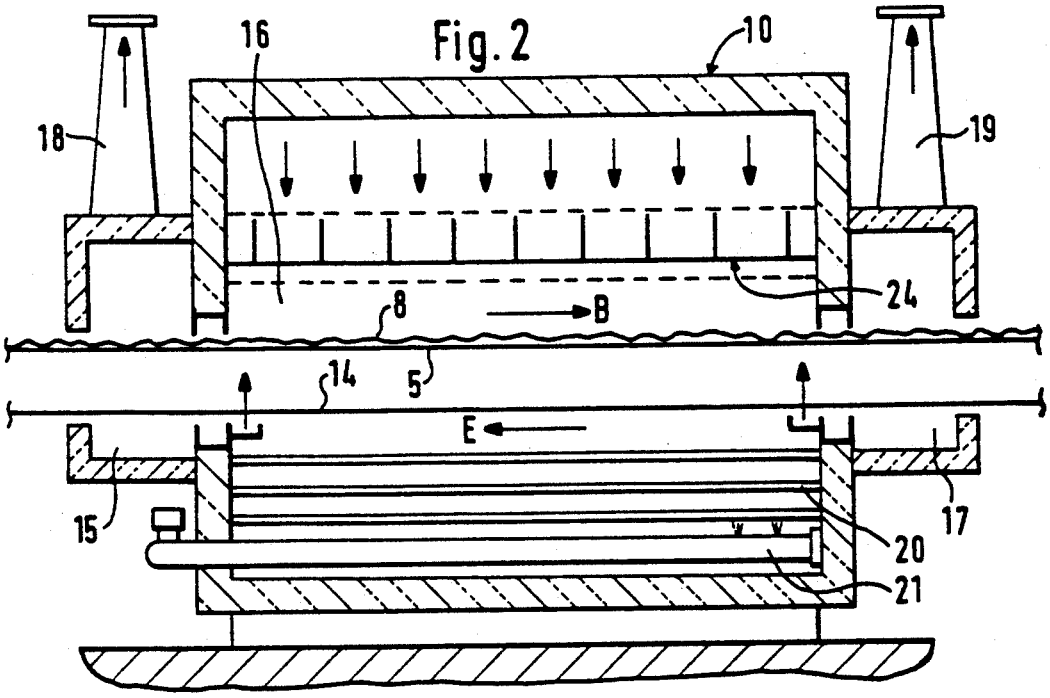
FIG. 2 is a longitudinal sectional view taken through the yarn treating chamber of FIG. 1.
Figure 3:
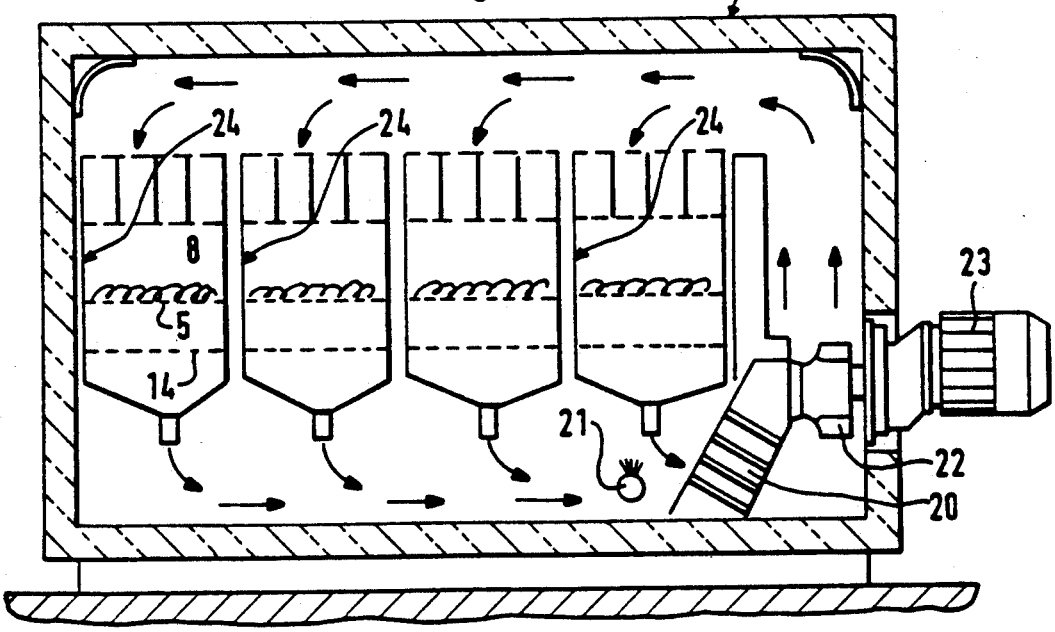
FIG. 3 is a cross sectional view taken through the yarn treating chamber of FIG. 2.

The views of FIGS. 2 and 3 show the heat treating chamber 10 in which the previously mechanically set yarns 1 are textured and heat set. The upper flights of the perforated conveyor belts 5 are shown passing through the yarn treating chamber 10 in the direction the arrow B on which the loops 8 are located. Also shown are the return flights 14 of the conveyor belts returning in the direction of the arrow E. The heat setting chamber 16 of the yarn treating chamber 10 is preceded by an inlet zone 15 and followed by an outlet zone 17. These zones 15 and 17 are intended to improve the sealing of the yarn treating chamber 10, in the longitudinal direction or lengthwise of the latter, at the locations at which the conveyor belts 5 enter and leave the chamber. Thus, the chamber 10 is an open chamber, operating under atmospheric pressure. The support surface of the conveyor belt 5 extends horizontally across a lateral width of the treating chamber 10 as depicted in FIG. 4.

Waste steam fittings 18 and 19 are connected with the zones 15 and 17. Electric heating means 20 are provided under the conveyor belts 5, which superheat the steam introduced by a steam main 21.

Under the conveyor belts 5 the steam main 21 extends in the longitudinal direction of the yarn treating installation, whereby the steam is resupplied. It is located in the vicinity of the electric heating means 20. By a blower 22 driven by a motor 23 (FIG. 3) the superheated steam is forced into a circulating flow. The yarn loops 8 located on the conveyor belts 5 are traversed by the steam from above, with the conveyor belts 5 being provided with guide canal units 24 for the flow of steam as described in more detail relative to FIG. 4.

Figure 4:
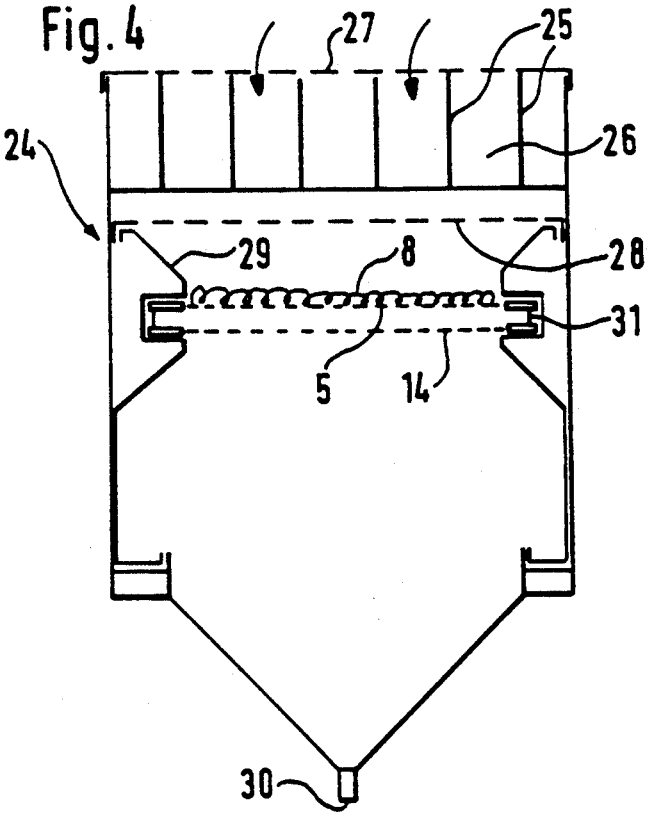
FIG. 4 is an enlarged view of one of the canal units depicted in FIG. 3 to demonstrate the guidance of steam flow.

Shown in FIG. 4 above a perforated textile net conveyor 5 is a so-called rectifier built into the guide canal unit 24. The rectifier comprises metal sheets 25 located adjacent to each other, and extending parallel to the direction of flow, with canals 26 defined therebetween. Above and under (i.e., upstream and downstream of) the rectifier 25, 26, perforated sheets 27 and 28 are provided to equalize the flow (and thus the temperature) over the entire working width of the yarn treating chamber 10. From the lower perforated sheet 28, metal sheets 29 define guide surfaces which extend lead obliquely inward to the lateral longitudinal edges of the conveyor belt 5, wherein the inclination of the sheets 29 is such that the effective flow cross section tapers toward the conveyor belt 5, so that the flow rate of superheated steam from the perforated sheet 28 is accelerated in this section. Thus, the guide surfaces are disposed downstream of the perforated sheet 28 and upstream of the conveyor belt 5 with reference to the flow of superheated steam. The sheets 29 are provided in the area of the conveyor belts 5 with groove like guides 31 for the conveyor belts. Under the lower flight 14 of each of the conveyor belts 5 the steam is drained in an accelerated manner from the guide canal unit 24 in an outlet slot 30.

Each of the conveyor belts 5 is guided laterally over its entire length by means of the mechanical guides 31 which extend in a straight line through the guide canal unit 24 and the yarn treating chamber 10.

Figure 5:
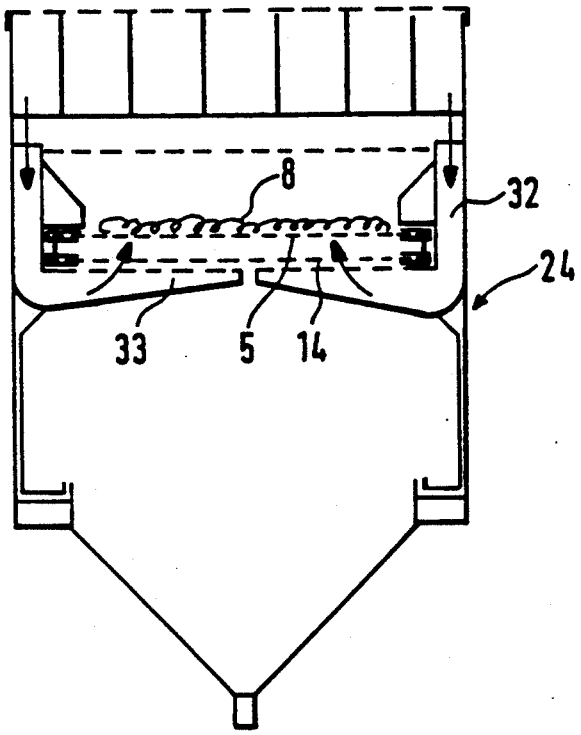
FIG. 5 is a view similar to FIG. 4 in the area of a climatic interlock at the outlet of the yarn treating chamber.
Figure 6:
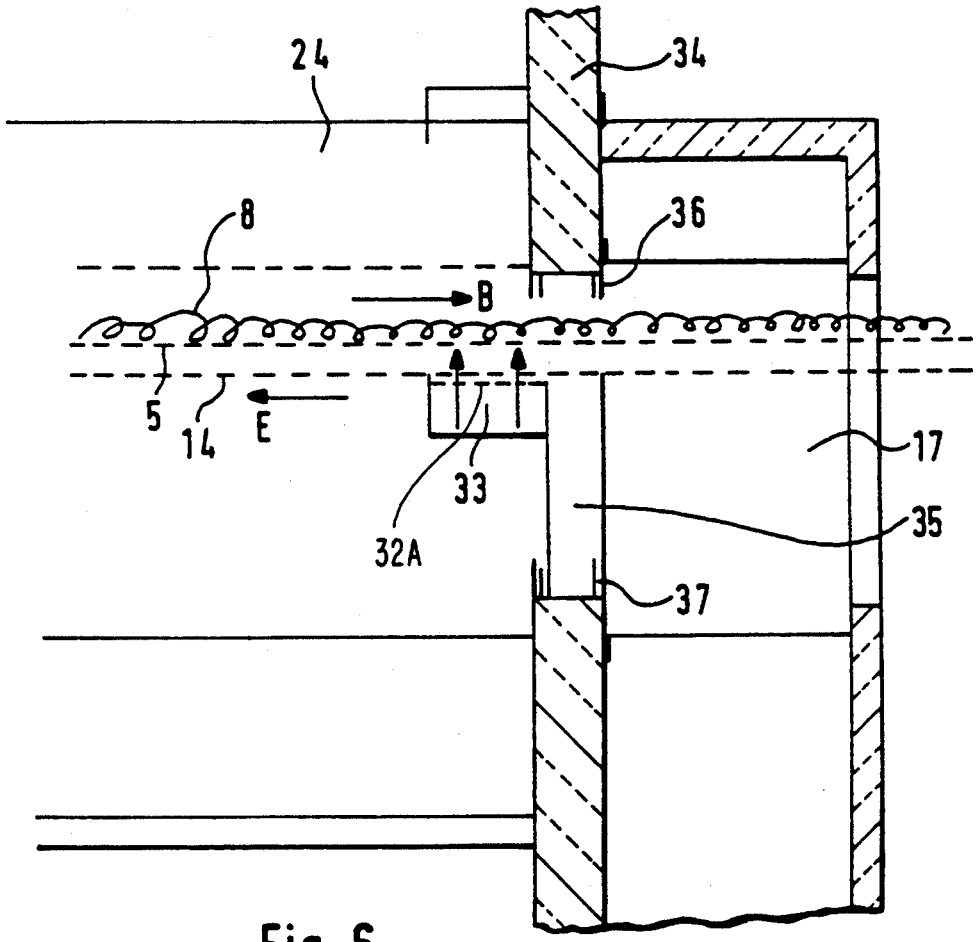
FIG. 6 is a longitudinal section through the treating chamber in the area of the climatic interlock.

In the area of the outlet zone 17 a climatic interlock 33 is provided on each of the guide canal units 24, as shown in a longitudinal section in FIG. 6. A comparable interlock is present in the area of the inlet zone 15. FIG. 5 shows the corresponding cross section in the area of the interlock. The interlock comprises a pair of channels 32 having upper ends arranged to receive downwardly flowing steam, and lower ends arranged to discharge the steam upwardly toward the lower flight 14 of the conveyor belt. Thus, in the area of the zones 15 and 17, steam flowing from above is diverted by the channels 32 such that it then flows in counter current from below through the perforations of the conveyor belt 5. This provides a certain degree of sealing so that no cold air flows from the outside into the treating chamber 10. The outlet ends of the channels 32 are formed by perforated sheets 32A over which the lower flights 14 of the conveyor belts 5) are passing at a short distance therefrom. The zones 15 and 17 are located outside the insulation 34 of the yarn treating chamber 10. In the area of the outlet opening 35 (and also in the area of the inlet opening which is not shown), additional narrow sheets 36 and 37 are located which are intended to retard the entry of cold outside air.

With the apparatus according to the invention mechanically textured yarns may be heat set in open systems with superheated steam. The yarns are not affected by the elevated pressures associated with saturated steam, so that the quality of the yarn is improved. The flow guidance means present make possible high flow velocities of steam through the yarns, with the additional perforated sheets permitting accurate control of the temperature and the flow. To prevent condensation, a net of a nonmetallic material is used.

Although the present invention has been described in connection with a preferred embodiment of the invention, it will be appreciated by those skilled in the art that additions, substitutions, modifications, and deletions not specifically described, may be made without departing from the spirit and scope of the invention as defined in the appended claims.

What is claimed is:

1. Apparatus for the continuous heat setting of yarns, comprising an open yarn heating chamber operating under atmospheric pressure, said chamber having a length and a lateral width and an inlet and an outlet disposed at respective ends of said length, conveyor belt means extending through said heating chamber and through said inlet and outlet for conveying yarn into and from said heating chamber, said conveyor belt means comprising a permeable nonmetallic net defining an upper support surface extending substantially horizontally across said lateral width, means for depositing yarn in loop form onto said support surface of said conveyor belt means, means for circulating superheated steam within said heating chamber, and steam guiding means situated above said conveyor belt means for guiding steam downwardly toward said conveyor belt means and toward the yarn disposed thereon, said guiding means comprising a flow rectifier defining laterally adjacent, lengthwise extending steam-conducting channels for conducting superheated steam downwardly, a perforated plate disposed downstream of said channels with reference to the direction of flow of superheated steam and extending across said width for distributing the superheated steam, and downwardly converging guide surfaces disposed downstream of said perforated plate and upstream of said conveyor belt means for causing superheated steam received from the perforations of said perforated plate to accelerate as it approaches said conveyor belt means.

2. Apparatus according to claim 1, wherein said conveyor belt means comprises a plurality of said permeable, nonmetallic net conveyor belts disposed in said heating chamber.

3. Apparatus according to claim 2, including means for guiding longitudinal edges of each yarn-supporting conveyor belt along the entire length of said belt in said heating chamber.

4. Apparatus according to claim 2, wherein each of said belts extends linearly through said heating chamber.

5. Apparatus according to claim 1 including a pair of sheets forming said guide surfaces, respectively, said sheets including means at lower ends thereof for guiding longitudinal edges of a respective conveyor belt.

6. Apparatus according to claim 1, wherein said heating chamber includes a conveyor inlet and a conveyor outlet, and climatic control means at said conveyor inlet and said conveyor outlet, each of said climatic control means comprising means for directing steam upwardly toward said conveyor belt means in counterflow relationship to steam guided downwardly from said steam guiding means.

7. Apparatus according to claim 1, wherein said nonmetallic net is coated plastic.

8. Apparatus according to claim 1, wherein said belt is endless.

9. A method of heat treating previously mechanically compressed yarn comprising the steps of depositing the yarn in loop form onto an upper support surface of a perforated nonmetallic net conveyor belt means, passing said conveyor belt means through an inlet of an open heating chamber and into said heating chamber which is operating at atmospheric pressure passing said conveyor belt means lengthwise through said heating chamber such that said support surface extends substantially horizontally across a lateral width of said heating chamber, circulating superheated steam within said heating chamber, guiding said steam downwardly toward said upper surface of said conveyor belt means and toward the yarn disposed thereon, and passing said conveyor belt means and the yarn through an outlet of said heating chamber, said guiding step including guiding superheated steam through a plurality of laterally adjacent lengthwise extending channels of a flow rectifier, then passing the superheated steam through a perforated plate disposed downstream of said channels with reference to the flow of superheated steam and extending across said lateral width, and then passing the superheated steam past a pair of downwardly converging guide surfaces disposed downstream of said perforated plate and upstream of said conveyor belt means so that superheated steam received from the perforations of said perforated plate is accelerated as it approaches said conveyor belt means.

* * * * *